US010934506B2

(12) United States Patent
Nietfeld

(10) Patent No.: US 10,934,506 B2
(45) Date of Patent: Mar. 2, 2021

(54) SILOXANE/HYDROCARBON COMPOSITIONS AND CLEANING METHOD USING THE SAME

(71) Applicant: 3M INNOVATIVE PROPERTIES COMPANY, St. Paul, MN (US)

(72) Inventor: Jon P. Nietfeld, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/307,755

(22) PCT Filed: Jun. 5, 2017

(86) PCT No.: PCT/US2017/035973
§ 371 (c)(1),
(2) Date: Dec. 6, 2018

(87) PCT Pub. No.: WO2017/214042
PCT Pub. Date: Dec. 14, 2017

(65) Prior Publication Data

US 2019/0256806 A1 Aug. 22, 2019

Related U.S. Application Data

(60) Provisional application No. 62/346,651, filed on Jun. 7, 2016.

(51) Int. Cl.

| | |
|---|---|
| ***C11D 9/36*** | (2006.01) |
| ***C11D 7/50*** | (2006.01) |
| ***C11D 3/16*** | (2006.01) |
| ***C11D 3/43*** | (2006.01) |
| ***C11D 17/00*** | (2006.01) |
| ***C11D 1/82*** | (2006.01) |
| ***C11D 11/00*** | (2006.01) |

(52) U.S. Cl.
CPC ..... *C11D 7/5027* (2013.01); *C11D 1/82* (2013.01); *C11D 3/16* (2013.01); *C11D 3/162* (2013.01); *C11D 3/43* (2013.01); *C11D 7/50* (2013.01); *C11D 7/5018* (2013.01); *C11D 7/5022* (2013.01); *C11D 11/00* (2013.01); *C11D 11/0023* (2013.01); *C11D 17/0043* (2013.01); *C11D 11/0041* (2013.01)

(58) Field of Classification Search
CPC ..... C11D 3/0073; C11D 3/162; C11D 3/18; C11D 3/185; C11D 3/187; C11D 3/2072; C11D 7/264; C11D 7/5004; C11D 7/509; C11D 9/36; C11D 11/0023
See application file for complete search history.

(56) References Cited

U.S. PATENT DOCUMENTS

| | | | | |
|---|---|---|---|---|
| 5,628,833 | A * | 5/1997 | McCormack | B01D 12/00 134/26 |
| 5,773,403 | A * | 6/1998 | Hijino | B01D 12/00 134/40 |
| 6,310,029 | B1 | 10/2001 | Kilgour | |
| 6,448,209 | B1 * | 9/2002 | Gatzke | C11D 7/24 510/189 |
| 8,669,222 | B2 | 3/2014 | Motsenbocker | |
| 2008/0280801 | A1 | 11/2008 | Dabela | |
| 2011/0056517 | A1 | 3/2011 | Motsenbocker | |
| 2013/0017986 | A1 | 1/2013 | Dabela | |
| 2014/0065432 | A1 * | 3/2014 | Wuerch | C09J 11/06 428/447 |
| 2014/0349916 | A1 | 11/2014 | Bolden | |
| 2018/0179476 | A1 * | 6/2018 | Pasin | C11D 7/5009 |

FOREIGN PATENT DOCUMENTS

| | | |
|---|---|---|
| CN | 103866340 | 6/2014 |
| DE | 202006008745 | 8/2006 |
| EP | 0576687 | 1/1994 |
| EP | 0787537 | 8/1997 |
| WO | WO 2016-193866 | 12/2016 |
| WO | WO 2016-193867 | 12/2016 |

OTHER PUBLICATIONS

International Search Report for PCT International Application No. PCT/US2017/035973, dated Jul. 26, 2017, 6 pages.
*California Consumer Products Regulations*, Subchapter 8.5, Article 2, 94508, last amended Sep. 17, 2014 (Register 2014, No. 38), 4 pages.
Material Safety Data Sheet for 3M High Power Brake Cleaner, P.N. 08893, Minnesota Mining and Manufacturing Company, Aug. 9, 1999, 7 pages.
Detergents for Industrial and Public Facilities, Zhang Yongnian et al., p. 191, China Light Industry Press, Jan. 31, 2000.

* cited by examiner

*Primary Examiner* — Charles I Boyer
(74) *Attorney, Agent, or Firm* — Kathleen B. Gross

(57) ABSTRACT

The compositions include a methylated siloxane liquid and a solvent comprising at least one of a ketone or ester each having up to six carbon atoms, a halogenated alkane having up to two carbon atoms, tetrachloroethene, 1-chloro-4-trifluoromethyl benzene, or ethane. The compositions can also include hydrocarbon solvent comprising at least one of toluene, xylene, or a saturated hydrocarbon represented by formula $C_xH_{2x+y}$, wherein x is from 5 to 8, and wherein y is 0 or 2 and/or propellant. The method can include applying the composition to a brake system component to clean the brake system component. The method can also include applying a composition including hexamethyldisiloxane to a brake system component to clean the brake system component.

18 Claims, No Drawings

SILOXANE/HYDROCARBON COMPOSITIONS AND CLEANING METHOD USING THE SAME

CROSS-REFERENCE TO RELATED APPLICATION

This application is a national stage filing under 35 U.S.C. 371 of PCT/US2017/035973, filed Jun. 5, 2017, which claims priority to U.S. Provisional Application No. 62/346,651, filed Jun. 7, 2016, the disclosure of which is incorporated by reference in its entirety herein.

BACKGROUND

In order to maintain proper functioning and performance of braking components (e.g. drums, rotors, calipers) on vehicles such as automobiles it is often necessary to clean the braking components (e.g. when replacing or inspecting brake pads or shoes) to remove any accumulated contaminates such as grease, oil, road tar, and/or brake dust. The most commonly used method of cleaning brake components involves the use of spray-applied, solvent-based brake cleaner compositions. Solvent based brake cleaners typically comprise fast-evaporating volatile organic compounds (VOCs) such as toluene, xylene, hexane, heptane, methyl alcohol and propane. However, in recent years several government regulatory groups have significantly decreased the percentage of VOC solvents that are allowed in brake cleaner compositions. In California, for example, the California Air Resources Board (CARB) has imposed a 10% VOC limit on brake cleaner compositions sold and/or used within the state of California.

Many commercial brake cleaner compositions include acetone, which is a low cost VOC-exempt solvent that evaporates quickly. However, since acetone is a polar solvent, compositions containing it are too polar to effectively dissolve grease and other non-polar contaminants. Chlorinated solvents (e.g., tetrachloroethylene) are an alternative to acetone. Several chlorinated solvents are VOC exempt; however, states such as California and New Jersey have banned the use of chlorinated solvents in brake cleaner compositions due to their suspected health effects. Other alternatives to chlorinated solvents and acetone are low vapor pressure (LVP) hydrocarbon solvents, which are also VOC exempt. Brake cleaner compositions including LVP hydrocarbon solvents are described in U.S. Pat. Appl. Pub. No. 2014/0349916 (Bolden). Other brake cleaner compositions are described in U.S. Pat. No. 6,448,209 (Gatzke et al.) and U.S. Pat. No. 8,669,222 (Motsenbocker).

In unrelated technologies, certain compositions including siloxanes have been reported to be useful as cleaning compositions. See, for example, U.S. Pat. No. 5,773,403 (Hijino et al.), U.S. Pat. No. 5,628,833 (McCormack et al.), and U.S. Pat. No. 6,310,029 (Kilgour et al.) and European Patent Application Publication EP787537, published on Aug. 6, 1997.

SUMMARY

The present disclosure provides compositions useful, for example, for removing oily contaminants from brake components and other articles. The compositions include a methylated siloxane liquid. In some embodiments, the composition unexpectedly provides superior cleaning performance over other compositions that do not contain the methylated siloxane liquid.

In one aspect, the present disclosure provides a composition that includes a methylated siloxane liquid, hydrocarbon solvent including at least one of toluene, xylene, or a saturated hydrocarbon represented by formula $C_xH_{2x+y}$, wherein x is from 5 to 8, and wherein y is 0 or 2, and a solvent including at least one of a ketone or ester each having up to six carbon atoms, a halogenated alkane having up to two carbon atoms, tetrachloroethene, 1-chloro-4-trifluoromethyl benzene, or ethane. In some embodiments, the composition includes not more than 30 percent by weight volatile organic solvent as defined in the *California Consumer Products Regulations*, Subchapter 8.5, Article 2, 94508, last amended Sep. 17, 2014 (Register 2014, No. 38). In some embodiments, the hydrocarbon solvent is present in an amount from 0.5 to 10 percent by weight, based on the total weight of the composition. In some embodiments, the methylated siloxane liquid is present in an amount from five to 30 percent by weight, based on the total weight of the composition.

In another aspect, the present disclosure provides an aerosol composition that includes propellant, a methylated siloxane liquid, and solvent comprising at least one of a ketone or ester each having up to six carbon atoms, a halogenated alkane having up to two carbon atoms, tetrachloroethene, 1-chloro-4-trifluoromethyl benzene, or ethane. If the methylated siloxane liquid is cyclic, the composition includes not more than 30 percent by weight of the cyclic methylated siloxane liquid, based on the total weight of the composition.

In another aspect, the present disclosure provides a method of cleaning a brake system component. The method includes applying the composition or the aerosol composition described above to the brake system component to clean the brake system component.

In another aspect, the present disclosure provides a method of cleaning a brake system component. The method includes applying a composition containing hexamethyldisiloxane to the brake system component to clean the brake system component.

In this application:

Terms such as "a", "an" and "the" are not intended to refer to only a singular entity, but include the general class of which a specific example may be used for illustration. The terms "a", "an", and "the" are used interchangeably with the term "at least one".

The phrase "comprises at least one of followed by a list refers to comprising any one of the items in the list and any combination of two or more items in the list. The phrase" at least one of followed by a list refers to any one of the items in the list or any combination of two or more items in the list.

The term "hydrocarbon" refers to compounds that have only carbon and hydrogen atoms.

All numerical ranges are inclusive of their endpoints and nonintegral values between the endpoints unless otherwise stated (e.g., 1 to 5 includes 1, 1.5, 2, 2.75, 3, 3.80, 4, 5, etc.).

DETAILED DESCRIPTION

Compositions according to the present disclosure include a methylated siloxane liquid. The methylated siloxane is liquid at room temperature. The methylated siloxane may be understood to be a non-cyclic (that is linear or branched) or cyclic completely methylated siloxane as defined in the *California Consumer Products Regulations*, Subchapter 8.5, Article 2, 94508, last amended Sep. 17, 2014 (Register 2014, No. 38).

Examples of useful non-cyclic methylated siloxanes can be represented by formula

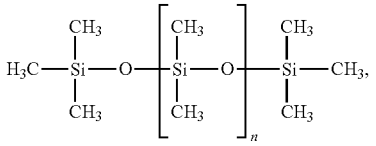

wherein n is in a range from 0 to 7, 0 to 5, 0 to 3, or 0 to 1. Examples of useful methylated siloxanes of this formula include hexamethyldisiloxane (n is 0), octamethyltrisiloxane (n is 1), decamethyltetrasiloxane (n is 2), dodecamethylpentasiloxane (n is 3), tetradecamethylhexasiloxane (n is 4), and hexadecamethylheptasiloxane (n is 5). An example of a useful branched methylated siloxane is methyltris(trimethylsiloxy)silane. In some embodiments of the compositions and aerosol compositions according to the present disclosure, the methylated siloxane is hexamethyldisiloxane.

Examples of useful cyclic methylated siloxanes can be represented by formula

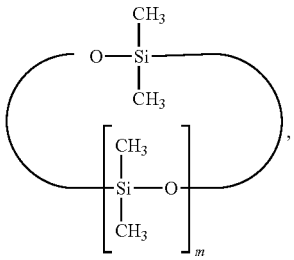

wherein typically m is 3 to 7 or 4 to 6. Examples of useful methylated siloxanes of this formula include octamethylcyclotetrasiloxane (m is 3), decamethylcyclopentasiloxane (m is 4), and dodecamethylcyclohexasiloxane (m is 5).

The methylated siloxane liquid may be present in the composition or aerosol composition in an amount up to 50 percent by weight (e.g., one to 50, 5 to 50, 7.5 to 50, or 10 to 50 percent by weight), based on the total weight of the composition. In some embodiments of the composition or aerosol composition, the methylated siloxane liquid is present in an amount from five to 30 percent by weight, 7.5 to 30 percent by weight, 10 to 30 percent by weight, or 25 to 50 percent by weight, based on the total weight of the composition.

Compositions according to the present disclosure, which include methylated siloxane liquids, are shown in the Examples, below, to be effective cleaning compositions. As described in the Examples, below, compositions according to the present disclosure were sprayed onto a vertically orientated greased panel, and the time required to remove the grease was recorded with a stopwatch. The panel was then dried for 5 minutes at 21° C. and weighed to determine the amount of grease removed. The can including the composition was weighed before and after the evaluation to determine the amount of cleaning composition used.

In the aerosol composition, if the methylated siloxane liquid is cyclic, the composition comprises not more than 30 percent by weight of the cyclic methylated siloxane liquid, based on the total weight of the composition. As shown in the Examples below, the benefit of the addition of a cyclic methylated siloxane liquid (e.g., octamethylcyclotetrasiloxane and decamethylcyclopentasiloxane) in a composition also including ten percent by weight heptane in acetone appears to be about the same when the cyclic methylated siloxane is present in a range from about ten percent by weight to about 30 percent by weight. See, for example, Examples 20 to 27. That is, the time to degrease the panel and the amount of grease removed was about the same for many compositions having a cyclic methylated siloxane in this range.

However, compositions including 100 percent by weight hexamethyldisiloxane were shown to be unexpectedly effective at cleaning. See, for example, Example 7 in the Examples, below. Accordingly, in some embodiments of the method of cleaning a brake system component according to the present disclosure, the composition including hexamethyldisiloxane applied to the brake system component includes at least 55, 60, 70, 75, 80, 90, or 95 percent by weight hexamethyldisiloxane, based on the total weight of the composition. The composition may include 100 percent hexamethyldisiloxane. In aerosol compositions for cleaning brake system components, for example, propellant can be included in an amount up to 20, 15, 10, or 5 percent by weight, based on the total weight of the aerosol composition. In some embodiments, the remainder of the composition can be composed of hexamethyldisiloxane.

In some embodiments, the composition includes not more than 50 percent by weight or not more than 30 percent by weight volatile organic solvent (VOC) as defined in the *California Consumer Products Regulations*, Subchapter 8.5, Article 2, 94508, last amended Sep. 17, 2014 (Register 2014, No. 38). Since VOC is broadly defined in the *California Consumer Products Regulations*, a person skilled in the art may understand this limitation to mean that the composition according the present disclosure includes not more than 50 percent by weight or not more than 30 percent by weight of solvent not listed as "exempt" or otherwise excluded in the *California Consumer Products Regulations*, Subchapter 8.5, Article 2, 94508, last amended Sep. 17, 2014 (Register 2014, No. 38). VOCs (e.g., those not listed as exempt or otherwise excluded) include hydrocarbon solvents (e.g., benzene, toluene, xylenes, and d-limonene); acyclic and cyclic ketones (e.g., pentanone, hexanone, cyclopentanone, and cyclohexanone); acyclic or cyclic acetals, ketals or ortho esters (e.g., diethoxy methane, dimethoxy methane, dipropoxy methane, dimethoxy ethane, diethoxy ethane, dipropoxy ethane, 2,2-dimethoxy propane, 2,2-diethoxy propane, 2,2-dipropoxy propane, 2,2-dimethyl-1,3-dioxalane, trimethyl orthoformate, triethyl orthoformate, trimethyl orthoacetate, triethyl orthoacetate, trimethyl orthobenzoate, and triethyl orthobenzoate); and alcoholic solvents (e.g., methanol, ethanol, or propanol such as isopropanol). A person skilled in the art understands the definition of VOC and can readily determine which solvents have exempt or excluded status in the *California Consumer Products Regulations*. In some embodiments, compositions and aerosol compositions according to the present disclosure include at least one of methanol, ethanol, or isopropanol. In these embodiments, methanol, isopropanol, and/or ethanol may be present in an amount up to 50, 40, 30, 25, 20, 10, 5, 3, 2, or 1 percent by weight, based on the total weight of the composition. In some embodiments, compositions and aerosol compositions according to the present disclosure are free of at least one of methanol, ethanol, or isopropanol.

In some embodiments, compositions and aerosol compositions according to the present disclosure include hydrocarbon solvent. Useful hydrocarbon solvents include aromatic hydrocarbon solvents (e.g., toluene and xylene), saturated hydrocarbon solvents having from 5 to 8 carbon atoms, and mixtures thereof. In some embodiments, the saturated hydrocarbon is represented by formula $C_xH_{2x+y}$, wherein x is from 5 to 8, and wherein y is 0 or 2. Examples of hydrocarbons represented by this formula include n-pentane, isopentane, n-hexane, isohexane, n-heptane, isoheptane, n-octane, isooctane, cyclopentane, methyl cyclohexane, and cyclohexane. Mixtures of any of these solvents may be useful in the compositions and aerosol compositions disclosed herein. In some embodiments, the composition or aerosol composition according to the present disclosure includes a heptane.

Hydrocarbon solvents disclosed herein meet the definition of a volatile organic solvent as defined above. In some embodiments of the composition and aerosol composition according to the present disclosure, the hydrocarbon solvent is present in an amount from 0.5 percent to 50 percent by weight, based on the total weight of the composition. In some embodiments of the composition and aerosol composition, the hydrocarbon solvent is present in an amount from 0.5 to 10 percent by weight, based on the total weight of the composition. In some embodiments of the composition and aerosol composition, the hydrocarbon solvent is present in an amount from 5 to 10 percent by weight, based on the total weight of the composition.

As shown in the Examples, below, the presence of the hydrocarbon solvent unexpectedly improves the cleaning efficiency of some embodiments of the composition and aerosol compositions disclosed herein. Even though hexadimethylsiloxane removed grease from the panel most effectively when it was used as the only ingredient other than propellant, a composition including ten percent by weight hexamethyldisiloxane and ten percent by weight heptane in 80 percent by weight acetone removed grease from the panel more quickly than a composition including 20 percent by weight hexamethyldisiloxane and 80 percent by weight acetone.

Compositions and aerosol compositions according to the present disclosure include a solvent comprising at least one of a ketone or ester each having up to six carbon atoms, a halogenated alkane having up to two carbon atoms, tetrachloroethene, 1-chloro-4-trifluoromethyl benzene, or ethane. Certain of these solvents are listed as exempt VOCs in the *California Consumer Products Regulations,* Subchapter 8.5, Article 2, 94508, last amended Sep. 17, 2014 (Register 2014, No. 38). The amount of these solvents typically varies inversely with the amounts of other components in the compositions and aerosol compositions according to the present disclosure. Any of these solvents or any combination of these solvents may be present in the composition or aerosol composition in at least 50, 55, 60, 70, 75, 80, 90, or 95 percent by weight, based on the total weight of the composition. In some embodiments, the solvent comprises tetrachloroethene.

Examples of a suitable halogenated alkanes having up to two carbon atoms include methylene chloride (dichloromethane), 1,1,1-trichloroethane (methyl chloroform), trichlorofluoromethane (CFC-11), dichlorodifluoromethane (CFC-12), 1,1,2-trichloro-1,2,2-trifluoroethane (CFC-113), 1,2-dichloro-1,1,2,2-tetrafluoroethane (CFC-114), chloropentafluoroethane (CFC-115), chlorodifluoromethane (HCFC-22), 1,1,1-trifluoro-2,2-dichloroethane (HCFC-123), 1,1-dichloro-1-fluoroethane (HCFC-141b), 1-chloro-1,1-difluoroethane (HCFC-142b), 2-chloro-1,1,1,2-tetrafluoroethane (HCFC-124), trifluoromethane (HFC-23), 1,1,2,2-tetrafluoroethane (HFC-134), 1,1,1,2-tetrafluoroethane (HFC-134a), pentafluoroethane (HFC-125), 1,1,1-trifluoroethane (HFC-143a), and 1,1-difluoroethane (HFC-152a).

Examples of suitable ketones having up to six carbon atoms include acetone, methyl ethyl ketone, and methyl butyl ketone. Examples of suitable esters having up to six carbon atoms include methyl acetate, ethyl acetate, propyl acetate, and butyl acetate (e.g., n-butyl acetate and t-butyl acetate). In some embodiments of the composition and aerosol composition of the present disclosure, the solvent comprises at least one of acetone, methyl acetate, or t-butyl acetate. In some embodiments, the solvent comprises acetone. As shown in Examples 12, 17, 18, and 19, below, compositions including the same amounts of heptane and hexamethyldisiloxane in each of acetone, methyl acetate, t-butyl acetate, and 1-chloro-4-trifluoromethyl benzene cleaned grease from panels in comparable time periods. However, in some instances, acetone is selected to provide a suitable combination of cleaning performance, low-cost, low-odor, and low-reactivity.

Compositions and aerosol compositions according to the present disclosure may optionally include a fragrance additive. An example of a suitable fragrance additive is d-limonene, which provides a citrus odor. Another example is a fragrance obtained under the trade designation "SOZIO FRESH & CLEAN SZ53271" from Sozio, Inc., Piscataway Township, N.J. When included in a composition of the present disclosure, a fragrance additive is typically added in an amount ranging from about 0.05% to about 3% by weight, based on the total weight of the composition. A suitable d-limonene fragrance additive is commercially available under the trade designation "D-LIMONENE, TECHNICAL GRADE" from Florida Chemical Company, Winter Haven, Fla.

In some embodiments of the composition and aerosol composition according to the present disclosure, the composition comprises not more than five percent by weight of a low vapor pressure (LVP) hydrocarbon solvent, based on the total weight of the composition. For the purposes of the present disclosure, an LVP is as defined in the *California Consumer Products Regulations*, Subchapter 8.5, Article 2, 94508, last amended Sep. 17, 2014 (Register 2014, No. 38). Accordingly, as used herein "LVP VOC" means a chemical "compound" or "mixture" that contains at least one carbon atom and meets one at least one of the following: (A) has a vapor pressure less than 0.1 mm Hg at 20° C., as determined by ARB (Air Resources Board of California) Method 310; (B) is a chemical "compound" with more than 12 carbon atoms, or a chemical "mixture" comprised solely of "compounds" with more than 12 carbon atoms, as verified by formulation data, and the vapor pressure and boiling point are unknown; (C) is a chemical "compound" with a boiling point greater than 216° C., as determined by ARB Method 310; or (D) is the weight percent of a chemical "mixture" that boils above 216° C., as determined by ARB Method 310. Examples of LVP solvent include petroleum distillates. While brake cleaner compositions including LVP hydrocarbon solvents can be effective at removing grease, they do not evaporate quickly, leaving the parts being cleaned wet for a longer period of time than desired. See, for example, the data in Table 3 for Comparative Example G, which includes a LVP solvent. In some embodiments, the composition or aerosol composition comprises not more than 4, 3, 2, 1, or 0.5 percent by weight of a low vapor pressure (LVP) hydrocarbon solvent, based on the total weight of the composition. In some embodiments, the composition or aerosol composition is free of a LVP hydrocarbon solvent.

In some embodiments, compositions according to the present disclosure are aerosols for convenient application. Aerosols typically include a propellant. Examples of suitable propellants include nitrogen, carbon dioxide, ethane, propane, isobutane, normal butane, dimethyl ether, 1,1-difluoroethane, trans-1,3,3,3-tetrafluoropropene, and mixtures thereof. Typically, liquid aerosol propellants such as propane, butane, and isobutane are added to the aerosol composition in an amount ranging from about 5% to about 15% by weight, based on the total weight of the composition. When the aerosol propellant is itself classified as a volatile organic compound (e.g., propane, butane, isobutane) the quantity of hydrocarbon solvent can be reduced in order to provide a composition having less than 50%, less than 45%, or less than 30% by weight total volatile organic compounds. When gases such as nitrogen and carbon dioxide are used as the propellant, the gas propellant is typically present in an amount ranging up to about 10%, 8%, 6%, 5%, or 2% by weight, based on the total weight of the composition. Propane suitable as an aerosol propellant is commercially available under the trade designation "A-110" from Technical Propellants, Inc.

Compositions and aerosol compositions according to the present disclosure may be prepared by mixing the components, for example, using a low shear type mixer. The order of addition of the various components has not been shown to affect the resulting composition. Explosion-proof manufacturing facilities and equipment may be useful for mixing and packaging of the brake cleaner compositions.

Aerosol compositions of the present disclosure can be conveniently provided in and aerosol spray can to facilitate application of the composition to difficult-to-reach surfaces, which are often present in brake system assemblies. In typical use, the aerosol compositions of the present disclosure is spray-applied to the surface(s) to be cleaned until such surface(s) are thoroughly wetted with the aerosol composition. After initial wetting, it may be desirable to further spray the aerosol composition onto the surface(s) to be cleaned in order to loosen and/or flush away contaminants. Multiple applications of the composition to the surface to be cleaned may be desired in some circumstances. Any run-off composition and contamination can be collected and disposed of using proper disposal techniques.

In some embodiments, compositions and aerosol compositions according to the present disclosure are useful as brake cleaner compositions. Methods according to the present disclosure include applying the composition or the aerosol composition to a brake system component to clean the brake system component. The brake system component can include at least one of drums, calipers, or rotors, for example.

Some Embodiments of the Disclosure

In a first embodiment, the present disclosure provides a composition comprising:

a methylated siloxane liquid;

a hydrocarbon solvent in an amount from 0.5 to 10 percent by weight, based on the total weight of the composition, wherein the hydrocarbon solvent comprises at least one of toluene, xylene, or a saturated hydrocarbon represented by formula $C_xH_{2x+y}$, wherein x is from 5 to 8, and wherein y is 0 or 2; and a solvent comprising at least one of a ketone or ester each having up to six carbon atoms, a halogenated alkane having up to two carbon atoms, tetrachloroethene, 1-chloro-4-trifluoromethyl benzene, or ethane.

In a second embodiment, the present disclosure provides a composition comprising:

a methylated siloxane liquid;

a solvent comprising at least one of a ketone or ester each having up to six carbon atoms, a halogenated alkane having up to two carbon atoms, tetrachloroethene, 1-chloro-4-trifluoromethyl benzene, or ethane;

hydrocarbon solvent comprising at least one of toluene, xylene, or a saturated hydrocarbon represented by formula $C_xH_{2x+y}$, wherein x is from 5 to 8, and wherein y is 0 or 2; and wherein the composition comprises not more than 30 percent by weight volatile organic solvent as defined in the *California Consumer Products Regulations*, Subchapter 8.5, Article 2, 94508, last amended Sep. 17, 2014 (Register 2014, No. 38).

In a third embodiment, the present disclosure provides the composition of the second embodiment, wherein hydrocarbon solvent is present in an amount from five to 30 percent by weight, based on the total weight of the composition.

In a fourth embodiment, the present disclosure provides the composition of any one of the first to third embodiments, wherein the hydrocarbon solvent is present in an amount from five to 10 percent by weight, based on the total weight of the composition.

In a fifth embodiment, the present disclosure provides the composition of any one of the first to fourth embodiments, wherein the methylated siloxane liquid is a linear or branched methylated siloxane.

In a sixth embodiment, the present disclosure provides the composition of any one of the first to fifth embodiments, wherein the methylated siloxane liquid is hexamethyl disiloxane.

In a seventh embodiment, the present disclosure provides the composition of any one of the first to sixth embodiments, wherein the methylated siloxane liquid is present in an amount from one to 50 percent by weight, based on the total weight of the composition.

In an eighth embodiment, the present disclosure provides the composition of the seventh embodiment, wherein the methylated siloxane liquid is present in an amount from five, 7.5, or ten to 30 percent by weight, based on the total weight of the composition.

In a ninth embodiment, the present disclosure provides the composition of any one of the first to eighth embodiments, wherein the hydrocarbon solvent is a heptane.

In a tenth embodiment, the present disclosure provides the composition of any one of the first to ninth embodiments, wherein the solvent comprises at least one of acetone, methyl acetate, or t-butyl acetate.

In an eleventh embodiment, the present disclosure provides the composition of the tenth embodiment, wherein the solvent comprises acetone.

In a twelfth embodiment, the present disclosure provides the composition of any one of the first to eleventh embodiments, wherein the composition comprises not more than five percent by weight of a low vapor pressure hydrocarbon solvent, based on the total weight of the composition.

In a thirteenth embodiment, the present disclosure provides the composition of any one of the first to twelfth embodiments, further comprising at least one of methanol, ethanol, or isopropanol.

In a fourteenth embodiment, the present disclosure provides the composition of any one of the first to thirteenth embodiments, further comprising propellant.

In a fifteenth embodiment, the present disclosure provides the composition of the fourteenth embodiment, wherein the propellant comprises at least one of nitrogen, carbon dioxide, ethane, propane, isobutane, normal butane, dimethyl ether, 1,1-difluoroethane, or trans-1,3,3,3-tetrafluoropropene.

In a sixteenth embodiment, the present disclosure provides an aerosol composition comprising:

propellant;

a methylated siloxane liquid; and a solvent comprising at least one of a ketone or ester each having up to six carbon atoms, a halogenated alkane having up to two carbon atoms, tetrachloroethene, 1-chloro-4-trifluoromethyl benzene, or ethane, wherein if the methylated siloxane liquid is cyclic, the composition comprises not more than 30 percent by weight of the cyclic methylated siloxane liquid, based on the total weight of the composition.

In a seventeenth embodiment, the present disclosure provides the aerosol composition of the sixteenth embodiment, wherein if the methylated siloxane liquid is cyclic, the composition comprises an amount in a range from ten percent by weight to 30 percent by weight of the cyclic methylated siloxane liquid, based on the total weight of the composition.

In an eighteenth embodiment, the present disclosure provides the aerosol composition of the sixteenth or seventeenth embodiment, wherein the methylated siloxane liquid is a linear or branched methylated siloxane liquid.

In a nineteenth embodiment, the present disclosure provides the aerosol composition of any one of the sixteenth to eighteenth embodiments, wherein the methylated siloxane liquid is hexamethyl disiloxane.

In a twentieth embodiment, the present disclosure provides the aerosol composition of any one of the eighteenth to the nineteenth embodiments, wherein the linear or branched methylated siloxane liquid is present in an amount from one, five, 7.5, or ten to 50 percent by weight, based on the total weight of the aerosol composition.

In a twenty-first embodiment, the present disclosure provides the aerosol composition of any one of the eighteenth to twentieth embodiments, wherein the linear or branched methylated siloxane is present in an amount from five, 7.5, or ten to 30 percent by weight, based on the total weight of the aerosol composition.

In a twenty-second embodiment, the present disclosure provides the aerosol composition of any one of the sixteenth to twenty-first embodiments, further comprising hydrocarbon solvent comprising at least one of toluene, xylene, or a saturated hydrocarbon represented by formula $C_xH_{2x+y}$, wherein x is from 5 to 8, and wherein y is 0 or 2.

In a twenty-third embodiment, the present disclosure provides the aerosol composition of the twenty-second embodiment, wherein the hydrocarbon solvent is present in an amount from 0.5 to 50 percent by weight, based on the total weight of the aerosol composition.

In a twenty-fourth embodiment, the present disclosure provides the aerosol composition of the twenty-second or twenty-third embodiment, wherein the hydrocarbon solvent is present in an amount up to 30 percent by weight, based on the total weight of the aerosol composition.

In a twenty-fifth embodiment, the present disclosure provides the aerosol composition of the twenty-second or twenty-third embodiment, wherein the hydrocarbon solvent is present in an amount from 0.5 to 10 percent by weight, based on the total weight of the aerosol composition.

In a twenty-sixth embodiment, the present disclosure provides the aerosol composition of any one of the twenty-second to twenty-fifth embodiments, wherein the hydrocarbon solvent is present in an amount from 5 to 10 percent by weight, based on the total weight of the aerosol composition.

In a twenty-seventh embodiment, the present disclosure provides the aerosol composition of any one of the sixteenth to twenty-fifth embodiments, wherein the hydrocarbon solvent is a heptane.

In a twenty-eighth embodiment, the present disclosure provides the aerosol composition of any one of the sixteenth to twenty-seventh embodiments, wherein the solvent comprises at least one of acetone, methyl acetate, or t-butyl acetate.

In a twenty-ninth embodiment, the present disclosure provides the aerosol composition of the twenty-eighth embodiment, wherein the solvent comprises acetone.

In a thirtieth embodiment, the present disclosure provides the aerosol composition of any one of the sixteenth to twenty-ninth embodiments, wherein the aerosol composition comprises not more than five percent by weight of a low vapor pressure hydrocarbon solvent, based on the total weight of the composition.

In a thirty-first embodiment, the present disclosure provides the aerosol composition of any one of the sixteenth to thirtieth embodiments, further comprising at least one of methanol, ethanol, or isopropanol.

In a thirty-second embodiment, the present disclosure provides the aerosol composition of any one of the sixteenth to thirty-first embodiments, wherein the propellant comprises at least one of nitrogen, carbon dioxide, ethane, propane, isobutane, normal butane, dimethyl ether, 1,1-difluoroethane, or trans-1,3,3,3-tetrafluoropropene.

In a thirty-third embodiment, the present disclosure provides the aerosol composition of the thirty-second embodiment or the composition of the fifteenth embodiment, wherein the propellant comprises at least one of nitrogen or carbon dioxide.

In a thirty-fourth embodiment, the present disclosure provides a method of cleaning a brake system component, the method comprising:

applying the composition of any one of the first to fifteenth embodiments or the aerosol composition of any one of the sixteenth to thirty-third embodiments to the brake system component to clean the brake system component.

In a thirty-fifth embodiment, the present disclosure provides the method of the thirty-fourth embodiment, wherein the brake system component comprises at least one of drums, calipers, or rotors.

In a thirty-sixth embodiment, the present disclosure provides the method of the thirty-fourth or thirty-fifth embodiments, wherein applying comprises spray applying.

In a thirty-seventh embodiment, the present disclosure provides a method of cleaning a brake system component, the method comprising:

applying a composition comprising hexamethyldisiloxane to the brake system component to clean the brake system component.

In a thirty-eighth embodiment, the present disclosure provides the method of the thirty-seventh embodiment, wherein the brake system component comprises at least one of drums, calipers, or rotors.

In a thirty-ninth embodiment, the present disclosure provides the method of the thirty-seventh or thirty-eighth embodiment, wherein applying comprises spray applying.

In a fortieth embodiment, the present disclosure provides the method of any one of the thirty-seventh to thirty-ninth embodiments, wherein the hexamethyldisiloxane is present in the composition in an amount from one, five, 7.5, or ten to 50 percent by weight, based on the total weight of the aerosol composition.

In a forty-first embodiment, the present disclosure provides the method of any one of the thirty-seventh to fortieth embodiments, wherein the hexamethyldisiloxane is present in the composition in an amount from five, 7.5, or ten to 30 percent by weight, based on the total weight of the aerosol composition.

In a forty-second embodiment, the present disclosure provides the method of any one of the thirty-seventh to forty-first embodiments, wherein the composition further comprising hydrocarbon solvent comprising at least one of toluene, xylene, or a saturated hydrocarbon represented by formula $C_xH_{2x+y}$, wherein x is from 5 to 8, and wherein y is 0 or 2.

In a forty-third embodiment, the present disclosure provides the method of the forty-second embodiment, wherein the hydrocarbon solvent is present in the composition in an amount from 0.5 to 50 percent by weight, based on the total weight of the composition.

In forty-fourth embodiment, the present disclosure provides the method of the forty-second or forty-third embodiment, wherein the hydrocarbon solvent is present in the composition in an amount up to 30 percent by weight, based on the total weight of the composition.

In forty-fifth embodiment, the present disclosure provides the method of any one of the forty-second to forty-fourth embodiments, wherein the hydrocarbon solvent is present in the composition in an amount from 0.5 to 10 percent by weight, based on the total weight of the composition.

In a forty-sixth embodiment, the present disclosure provides the method of any one of the forty-second to forty-fifth embodiments, wherein the hydrocarbon solvent is present in the composition in an amount from 5 to 10 percent by weight, based on the total weight of the composition.

In a forty-seventh embodiment, the present disclosure provides the method of any one of the forty-second to forty-sixth embodiments, wherein the hydrocarbon solvent is a heptane.

In a forty-eighth embodiment, the present disclosure provides the method of any one of the thirty-seventh to forty-seventh embodiments, wherein the composition further comprises a solvent comprising at least one of a ketone or ester each having up to six carbon atoms, a halogenated alkane having up to two carbon atoms, tetrachloroethene, 1-chloro-4-trifluoromethyl benzene, or ethane.

In a forty-ninth embodiment, the present disclosure provides the method of the forty-eighth embodiment, wherein the solvent comprises at least one of acetone, methyl acetate, or t-butyl acetate.

In a fiftieth embodiment, the present disclosure provides the method of the forty-ninth embodiment, wherein the solvent comprises acetone.

In a fifty-first embodiment, the present disclosure provides the method of any one of the thirty-seventh to fiftieth embodiments, wherein the aerosol composition comprises not more than five percent by weight of a low vapor pressure hydrocarbon solvent, based on the total weight of the composition.

In a fifty-second embodiment, the present disclosure provides the method of any one of the thirty-seventh to fifty-first embodiments, wherein the composition further comprises at least one of methanol, ethanol, or isopropanol.

In a fifty-third embodiment, the present disclosure provides the method of any one of the thirty-seventh to fifty-second embodiments, wherein the composition further comprises propellant.

In a fifty-fourth embodiment, the present disclosure provides the method of the fifty-third embodiment, wherein the propellant comprises at least one of nitrogen, carbon dioxide, ethane, propane, isobutane, normal butane, dimethyl ether, 1,1-difluoroethane, or trans-1,3,3,3-tetrafluoropropene.

In a fifty-fifth embodiment, the present disclosure provides the method of the fifty-fourth embodiment, wherein the propellant comprises at least one of nitrogen or carbon dioxide.

Embodiments of the compositions and methods disclosed herein are further illustrated by the following examples, but the particular materials and amounts thereof recited in these examples, as well as other conditions and details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Centigrade
cm: centimeter
CPS: decamethylcyclopentasiloxane
CTS: octamethylcyclotetrasiloxane
CTFMB: 1-chloro-4-(trifluoromethyl)benzene
HMDS: hexamethyldisiloxane
KPa: kilopascal
mL: milliliter
MA: methyl acetate
psi: pounds per square inch
s: second
TBA: t-butyl acetate
VOC: volatile organic compound
wt. %: weight percent

Illustrative Example A (IE. A)

An aerosol can containing 363 grams of acetone was crimped closed with a male valve. The can was then charged with carbon dioxide ($CO_2$) for 30 seconds at an incoming line pressure of 120 psi (827.4 KPa) to provide approximately 5-8 wt. % $CO_2$. A female actuator was then fitted over the male valve and the contents allowed to stabilize inside the aerosol can for 16 hours at 21° C. The pressure after stabilization and before testing was between 60-75 psi (413.7-517.1 KPa).

Illustrative Example B (I. E. B)

The procedure generally described for preparing Illustrative Example A was repeated, wherein 10 wt. % of the acetone was replaced by an equal weight of heptane.

Illustrative Example C (I. E. C)

The procedure generally described for preparing Illustrative Example A was repeated, wherein 20 wt. % of the acetone was replaced by an equal weight of heptane.

Comparative D

A commercially available brake cleaner, having 100 wt. % VOC, obtained under the trade designation "3M HIGH POWER BRAKE CLEANER, PART No. 08880", from 3M Company, St. Paul, Minn. The VOC components consisted of solvent naphtha, propane, xylene, methanol and ethylbenzene.

Comparative E

A commercially available brake cleaner, having 45 wt. % VOC, obtained under the trade designation "3M HIGH POWER BRAKE CLEANER, PART No. 08180", from 3M Company. The VOC components consisted of solvent naphtha, propane, xylene and ethylbenzene. Acetone was the non-VOC component.

Comparative F

A commercially available brake cleaner, having 10 wt. % VOC, obtained under the trade designation "3M HIGH POWER BRAKE CLEANER, PART No. 08179", from 3M Company. The VOC components consisted of solvent naphtha, xylene, paraffins and ethylbenzene. Acetone was the non-VOC component.

Comparative G

A commercially available brake cleaner, having 10 wt. % VOC, obtained under the trade designation "ZEP AUTOMOTIVE NON-CHLORINATED BRAKE CLEANER Part. No. ZAA735", from ZEP, Inc., Marietta, Ga. The VOC component consisted of solvent naphtha. Acetone and petroleum distillates were the non-VOC components.

Examples 1-7

The procedure generally described for preparing Illustrative Example A was repeated, wherein 10, 20, 25, 35, 50, 75 and 100 wt. % of the acetone was replaced by an equal weight of HMDS.

Examples 8-13

The procedure generally described for preparing Illustrative Example B was repeated, wherein the weight ratio of acetone to HMDS was adjusted to 85:5; 80:10; 75:15; 70:20; 65:25 and 60:30, respectively. The amount of heptane remained constant at 10 wt. %.

Illustrative Example H (I. E. H)

The procedure generally described for preparing Illustrative Example A was repeated, wherein the acetone was replaced with methyl acetate (MA) and heptane in a weight ratio of 90:10, respectively.

Illustrative Example I (I. E. I)

The procedure generally described for preparing Illustrative Example A was repeated, wherein the acetone was replaced with t-butyl acetate (TBA) and heptane in a weight ratio of 90:10, respectively.

Illustrative Example J (I. E. J)

The procedure generally described for preparing Illustrative Example A was repeated, wherein the acetone was replaced with 1-chloro-4-(trifluoromethyl)benzene (CTFMB) and heptane in a weight ratio of 90:10, respectively.

Example 14

The procedure generally described for preparing Illustrative Example A was repeated, wherein the acetone was replaced with MA, heptane and HMDS in a weight ratio of 63.2:10.5:26.3, respectively.

Example 15

The procedure generally described for preparing Illustrative Example A was repeated, wherein the acetone was replaced with TBA, heptane, and HMDS in a weight ratio of 63.2:10.5:26.3, respectively.

Example 16

The procedure generally described for preparing Illustrative Example A was repeated, wherein the acetone was replaced with CTFMB, heptane and HMDS in a weight ratio of 63.2:10.5:26.3, respectively.

Example 17

The procedure generally described for preparing Example 9 was repeated, wherein the HMDS was replaced by an equal weight of octamethylcyclotetrasiloxane (CTS).

Examples 18-21

The procedure generally described for preparing Example 17 was repeated, wherein the weight ratio of acetone to CTS was adjusted to 75:15; 70:20; 65:25 and 60:30, respectively. The amount of heptane remained constant at 10 wt. %.

Example 22

The procedure generally described for preparing Example 17 was repeated, wherein the CTS was replaced by an equal weight of decamethylcyclopentasiloxane (CPS).

Examples 23-24

The procedure generally described for preparing Example 22 was repeated, wherein the weight ratio of acetone to CPS was adjusted to 75:15 and 70:20, respectively. The amount of heptane remained constant at 10 wt. %.

Compositions are listed in Table 1.

TABLE 1

| | Composition (wt. %) | | | | | | | | VOC |
|---|---|---|---|---|---|---|---|---|---|
| Example | Acetone | Heptane | HMDS | MA | TBA | CTFMB | CTS | CPS | (wt. %) |
| I. E. A | 100 | 0 | 0 | 0 | 0 | 0 | 0 | 0 | 0 |
| I. E. B | 90 | 10 | 0 | 0 | 0 | 0 | 0 | 0 | 10 |
| I. E. C | 80 | 20 | 0 | 0 | 0 | 0 | 0 | 0 | 20 |
| Ex. 1 | 90 | 0 | 10 | 0 | 0 | 0 | 0 | 0 | 0 |
| Ex. 2 | 80 | 0 | 20 | 0 | 0 | 0 | 0 | 0 | 0 |

TABLE 1-continued

| Example | Composition (wt. %) | | | | | | | | VOC |
|---|---|---|---|---|---|---|---|---|---|
| | Acetone | Heptane | HMDS | MA | TBA | CTFMB | CTS | CPS | (wt. %) |
| Ex 3 | 75 | 0 | 25 | 0 | 0 | 0 | 0 | 0 | 0 |
| Ex. 4 | 65 | 0 | 35 | 0 | 0 | 0 | 0 | 0 | 0 |
| Ex. 5 | 50 | 0 | 50 | 0 | 0 | 0 | 0 | 0 | 0 |
| Ex. 6 | 25 | 0 | 75 | 0 | 0 | 0 | 0 | 0 | 0 |
| Ex. 7 | 0 | 0 | 100 | 0 | 0 | 0 | 0 | 0 | 0 |
| Ex. 8 | 85 | 10 | 5 | 0 | 0 | 0 | 0 | 0 | 10 |
| Ex. 9 | 80 | 10 | 10 | 0 | 0 | 0 | 0 | 0 | 10 |
| Ex. 10 | 75 | 10 | 15 | 0 | 0 | 0 | 0 | 0 | 10 |
| Ex. 11 | 70 | 10 | 20 | 0 | 0 | 0 | 0 | 0 | 10 |
| Ex. 12 | 65 | 10 | 25 | 0 | 0 | 0 | 0 | 0 | 10 |
| Ex. 13 | 60 | 10 | 30 | 0 | 0 | 0 | 0 | 0 | 10 |
| I. E. H | 0 | 10 | 0 | 90 | 0 | 0 | 0 | 0 | 10 |
| I. E. I | 0 | 10 | 0 | 0 | 90 | 0 | 0 | 0 | 10 |
| I. E. J | 0 | 10 | 0 | 0 | 0 | 90 | 0 | 0 | 10 |
| Ex. 14 | 0 | 10.5 | 26.3 | 63.2 | 0 | 0 | 0 | 0 | 10 |
| Ex. 15 | 0 | 10.5 | 26.3 | 0 | 63.2 | 0 | 0 | 0 | 10 |
| Ex. 16 | 0 | 10.5 | 26.3 | 0 | 0 | 63.2 | 0 | 0 | 10 |
| Ex. 17 | 80 | 10 | 0 | 0 | 0 | 0 | 10 | 0 | 10 |
| Ex. 18 | 75 | 10 | 0 | 0 | 0 | 0 | 15 | 0 | 10 |
| Ex. 19 | 70 | 10 | 0 | 0 | 0 | 0 | 20 | 0 | 10 |
| Ex. 20 | 65 | 10 | 0 | 0 | 0 | 0 | 25 | 0 | 10 |
| Ex. 21 | 60 | 10 | 0 | 0 | 0 | 0 | 30 | 0 | 10 |
| Ex. 22 | 80 | 10 | 0 | 0 | 0 | 0 | 0 | 10 | 10 |
| Ex. 23 | 75 | 10 | 0 | 0 | 0 | 0 | 0 | 15 | 10 |
| Ex. 24 | 70 | 10 | 0 | 0 | 0 | 0 | 0 | 20 | 10 |

Test Procedures

Cleaning Efficacy

A 4 by 8 inch (10.16 by 15.24 cm) 16-gauge (1.50 mm) cold rolled steel test panel was thoroughly cleaned by spraying the panel with brake cleaner Comparative E and wiped with a lint free towel. Any residual brake cleaner was allowed to evaporate off for 5 minutes at 21° C., after which the panel was weighed. Approximately 0.4 grams of white lithium grease, obtained under the trade designation "3M WHITE GREASE (LITHIUM LUBE), Part No. 08875", obtained from 3M Company, was evenly sprayed onto an area of 1.5 by 4 inches (3.81 by 10.16 cm) on the steel panel. The solvents in the white lithium grease were evaporated off for 5 minutes at 21° C. before the panel was reweighed and the amount of lithium grease recorded.

A 4-inch (10.16 cm) extension tube was inserted into the actuator of the sample aerosol can and the weight recorded. The brake cleaner was then sprayed onto a vertically orientated greased panel at a distance of 12 inches (30.48 cm), and the time required to remove the grease recorded by means of a stopwatch. Spraying was discontinued at approximately 40 seconds even if grease remained on the panel. The panel was then dried for 5 minutes at 21° C., reweighed, and the wt. % of grease removed calculated. Likewise, the aerosol can was reweighed and the amount of brake cleaner used also calculated. Results are listed in Tables 2 and 3.

Evaporation Time

Approximately 5 mL of Comparative A was sprayed into a 40 mL glass vial, the vial then sealed, and held for 5 minutes at 21° C. A clean steel test panel was placed on an analytical balance, the weight tared, after which 0.2 grams of the brake cleaner sample was transferred to the panel surface. The time required for the cleaner to fully evaporate, as defined by the panel returning to its tared weight, was recorded. This procedure was repeated for Comparatives D-G, and Examples 7 and 9. Results are listed in Table 3.

TABLE 2

| Sample | VOC (wt. %) | Clean Time (s) | Amount Used (grams) | Grease Removed (wt. %) |
|---|---|---|---|---|
| I.E.A | 0 | ≥40 | 236.4 | 32 |
| I.E.B | 10 | ≥40 | 223.1 | 80 |
| I.E.C | 20 | 16.67 | 91.36 | 100 |
| Example 1 | 0 | ≥40 | 242.3 | 45 |
| Example 2 | 0 | ≥40 | 223.2 | 80 |
| Example 3 | 0 | 20.88 | 106.3 | 98 |
| Example 4 | 0 | 12.67 | 82.0 | 97 |
| Example 5 | 0 | 9.27 | 51.26 | 96 |
| Example 6 | 0 | 7.76 | 55.5 | 98 |
| Example 7 | 0 | 5.38 | 71.5 | 97 |
| Example 8 | 10 | ≥40 | 259.48 | 98 |
| Example 9 | 10 | 16.53 | 91.13 | 94 |
| Example 10 | 10 | 13.23 | 69.9 | 95 |
| Example 11 | 10 | 10.11 | 63.85 | 99 |
| Example 12 | 10 | 9.42 | 59.81 | 93 |
| Example 13 | 10 | 7.87 | 52.5 | 95 |
| I.E.H | 10 | 24.36 | 149.14 | 99 |
| I.E.I | 10 | 9.45 | 67.98 | 100 |
| I.E.J | 10 | 7.24 | 69.07 | 97 |
| Example 14 | 10 | 11.41 | 73.60 | 100 |
| Example 15 | 10 | 9.23 | 62.43 | 100 |
| Example 16 | 10 | 7.13 | 62.55 | 100 |
| Example 17 | 10 | 24.98 | 130.32 | 98 |
| Example 18 | 10 | 24.65 | 125.18 | 100 |
| Example 19 | 10 | 28.51 | 153.75 | 100 |
| Example 20 | 10 | 23.94 | 143.19 | 94 |
| Example 21 | 10 | 23.48 | 143.3 | 92 |
| Example 22 | 10 | 21.55 | 114.49 | 98 |
| Example 23 | 10 | 25.97 | 145.86 | 100 |
| Example 24 | 10 | 21.68 | 123.91 | 70 |

TABLE 3

| Sample | VOC (wt. %) | Clean Time (s) | Amount Used (grams) | Grease Removed (wt. %) | Evaporation Time (s) |
|---|---|---|---|---|---|
| I.E.A | 0 | ≥40 | 236.4 | 32 | 98 |
| Comparative D | 100 | 7.30 | 38.5 | 97 | 170 |

TABLE 3-continued

| Sample | VOC (wt. %) | Clean Time (s) | Amount Used (grams) | Grease Removed (wt. %) | Evaporation Time (s) |
|---|---|---|---|---|---|
| Comparative E | 45 | 13.45 | 57.5 | 99 | 165 |
| Comparative F | 10 | ≥40 | 181.1 | 71 | 141 |
| Comparative G | 10 | 18.55 | 52.9 | 95 | >3600 |
| Example 7 | 0 | 5.38 | 71.5 | 97 | 182 |
| Example 9 | 10 | 16.53 | 91.13 | 94 | 182 |

Various modifications and alterations of this disclosure may be made by those skilled the art without departing from the scope and spirit of the disclosure, and it should be understood that this invention is not to be unduly limited to the illustrative embodiments set forth herein.

What is claimed is:

1. A composition comprising:

a linear or branched methylated siloxane liquid in an amount from five to 30 percent by weight, based on the total weight of the composition;

a hydrocarbon solvent in an amount from 5 to 10 percent by weight, based on the total weight of the composition, wherein the hydrocarbon solvent comprises at least one of toluene, xylene, or a saturated hydrocarbon represented by formula $C_xH_{2x+y}$, wherein x is from 5 to 8, and wherein y is 0 or 2; and a solvent comprising at least one of a ketone or ester each having up to six carbon atoms, a halogenated alkane having up to two carbon atoms, tetrachloroethene, 1-chloro-4-trifluoromethyl benzene, or ethane.

2. A composition comprising:

a methylated siloxane liquid in an amount from five to 30 percent by weight, based on the total weight of the composition;

a solvent in an amount of at least 50 percent by weight, based on the total weight of the composition, the solvent comprising at least one of a ketone or ester each having up to six carbon atoms, a halogenated alkane having up to two carbon atoms, tetrachloroethene, 1-chloro-4-trifluoromethyl benzene, or ethane; and hydrocarbon solvent comprising at least one of toluene, xylene, or a saturated hydrocarbon represented by formula $C_xH_{2x+y}$, wherein x is from 5 to 8, and wherein y is 0 or 2, wherein the hydrocarbon solvent is present in the composition in an amount from 5 to 10 percent by weight, based on the total weight of the composition, and wherein the composition comprises not more than 30 percent by weight volatile organic solvent as defined in the *California Consumer Products Regulations*, Subchapter 8.5, Article 2, 94508, last amended Sep. 17, 2014 (Register 2014, No. 38).

3. The composition of claim 1, further comprising propellant.

4. The composition of claim 3, wherein the propellant comprises at least one of nitrogen, carbon dioxide, ethane, propane, isobutane, normal butane, dimethyl ether, 1,1-difluoroethane, or trans-1,3,3,3 -tetrafluoropropene.

5. The composition of claim 4, wherein the propellant comprises at least one of nitrogen or carbon dioxide.

6. The composition of claim 2, wherein the methylated siloxane liquid is a linear or branched methylated siloxane liquid.

7. The composition of claim 6, wherein the methylated siloxane liquid is hexamethyl disiloxane.

8. The composition of claim 2, wherein the solvent comprises at least one of acetone, methyl acetate, or t-butyl acetate.

9. The composition of claim 2, wherein the composition comprises not more than five percent by weight of a low vapor pressure hydrocarbon solvent, based on the total weight of the composition.

10. The composition of claim 2, further comprising at least one of methanol, ethanol, or isopropanol.

11. A method of cleaning a brake system component, the method comprising:

applying the composition of claim 2 to the brake system component to clean the brake system component.

12. A method of cleaning a brake system component, the method comprising:

applying a composition comprising hexamethyldisiloxane and hydrocarbon solvent to the brake system component to clean the brake system component, wherein the hydrocarbon solvent comprises at least one of toluene, xylene, or a saturated hydrocarbon represented by formula $C_xH_{2x+y}$, wherein x is from 5 to 8, and wherein y is 0 or 2, wherein the hydrocarbon solvent is present in the composition in an amount from 5 to 10 percent by weight, based on the total weight of the composition, and wherein the hexamethyldisiloxane is present in an amount from five to 30 percent by weight, based on the total weight of the composition.

13. The composition of claim 2, wherein the solvent comprises acetone, and wherein the hydrocarbon solvent is a heptane.

14. The composition of claim 1, wherein the linear or branched methylated siloxane liquid is hexamethyl disiloxane.

15. The composition of claim 1, wherein the solvent comprises at least one of acetone, methyl acetate, or t-butyl acetate.

16. The composition of claim 1, wherein the composition comprises not more than five percent by weight of a low vapor pressure hydrocarbon solvent, based on the total weight of the composition.

17. The composition of claim 1, further comprising at least one of methanol, ethanol, or isopropanol.

18. The composition of claim 1, wherein the solvent comprises acetone, and wherein the hydrocarbon solvent is a heptane.

* * * * *